US008683826B2

(12) United States Patent
Crafton

(10) Patent No.: US 8,683,826 B2
(45) Date of Patent: Apr. 1, 2014

(54) EARRING AND METHOD OF USING SAME

(76) Inventor: Bryan Casey Crafton, Chevy Chase, MD (US)

( * ) Notice: Subject to any disclaimer, the term of this patent is extended or adjusted under 35 U.S.C. 154(b) by 69 days.

(21) Appl. No.: 13/357,401

(22) Filed: Jan. 24, 2012

(65) Prior Publication Data

US 2013/0186136 A1 Jul. 25, 2013

(51) Int. Cl.
*A44C 7/00* (2006.01)

(52) U.S. Cl.
USPC ..... 63/40; 63/12; 63/14.1

(58) Field of Classification Search
None
See application file for complete search history.

(56) References Cited

U.S. PATENT DOCUMENTS

| | | | | |
|---|---|---|---|---|
| D164,731 | S | 10/1951 | Philippe | |
| D246,357 | S | 11/1977 | Durante | |
| D273,472 | S * | 4/1984 | Goldstein | D11/75 |
| D331,975 | S | 12/1992 | Pospisil | |
| 5,771,715 | A | 6/1998 | Soukenik | |
| D442,110 | S | 5/2001 | Edmond | |
| 6,450,814 | B1 | 9/2002 | Brittian | |
| D567,132 | S | 4/2008 | Bulgari | |
| 7,748,145 | B2 * | 7/2010 | Jones et al. | 36/136 |
| D637,937 | S | 5/2011 | Gaspard | |
| D645,376 | S | 9/2011 | Bulgari | |
| 2006/0292517 | A1 | 12/2006 | Smith | |
| 2009/0120131 | A1 | 5/2009 | Borowski | |

* cited by examiner

*Primary Examiner* — Jack W. Lavinder
(74) *Attorney, Agent, or Firm* — Garcia-Zamor IP Law; Ruy M. Garcia-Zamor

(57) ABSTRACT

An earring and method of using same to accessorize a wearer's appearance. A band is preferably detachably engageable with the earring body. The band may be colored to facilitate color coordination by a wearer.

18 Claims, 7 Drawing Sheets

EARRING AND METHOD OF USING SAME

BACKGROUND

The present invention relates generally to earrings and, more specifically, to methods and devices that facilitate the coordination of earrings with braces or other apparel or items.

Conventional earrings typically only coordinate with one type, style or color of clothing, hair, etc. This results in wearers needing to own a great number of earrings for various occasions.

It may be advantageous to provide an earring and a method of using an earring to accessorize a wearer's appearance that is efficient to manufacture, can be sold as a kit, can be modified for any outfit, is appealing to children and adults, and/or which can accessorize glasses, necklaces and/or braces.

SUMMARY

One embodiment of the present invention is directed to an earring including an earring body having first and second opposing surfaces. A plurality of supports are positioned on the first opposing surface and are each configured to provide a catch. A band is detachably engaged with the plurality of supports. An ear attachment mechanism is disposed on the second opposing surface.

In a separate aspect, one embodiment of the present invention is directed to a method of using earrings to accessorize a wearer's appearance. The method includes the step of providing an earring. The earring includes an earring body having first and second opposing surfaces. A plurality of supports are positioned on the first opposing surface and are each configured to provide a catch. An ear attachment mechanism is disposed on the second opposing surface. The method further includes the step of providing a band that is detachably engaged with the plurality of supports. The band having a color which accessorizes the wearer's appearance.

In a separate aspect, one embodiment of the present invention is directed to a method of using earrings to accessorize a wearer's appearance. The method includes the step of providing an earring. The earring includes an earring body having first and second opposing surfaces. A plurality of supports are positioned on the first opposing surface and are each configured to provide a catch. An ear attachment mechanism is disposed on the second opposing surface. The method further includes the step of positioning a band so as to detachably engage the plurality of supports of the earring. The band has a color which coordinates with dental braces bands positioned on braces worn by the wearer of the earring.

In a separate aspect, one embodiment of the present invention is directed to a method of using earrings to accessorize a wearer's appearance. The method includes the step of providing an earring. The earring includes a magnetic component therein and/or thereon. An ear attachment mechanism is disposed on the second opposing surface. The method further includes the step of providing a band that is that is detachably engaged to the earring by the magnetic component. The band having a color which accessorizes the wearer's appearance.

In a separate aspect, one embodiment of the present invention is directed to a method of using earrings to accessorize a wearer's appearance. The method includes the step of providing an earring. An ear attachment mechanism is disposed on the second opposing surface. The method further includes the step of providing a band that is that is detachably engaged to the earring by an adhesive. The band having a color which accessorizes the wearer's appearance.

In a separate aspect, one embodiment of the present invention is directed to an earring including an earring body having first and second opposing surfaces, A band is detachably engaged with the first opposing surface. An ear attachment mechanism is disposed on the second opposing surface.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
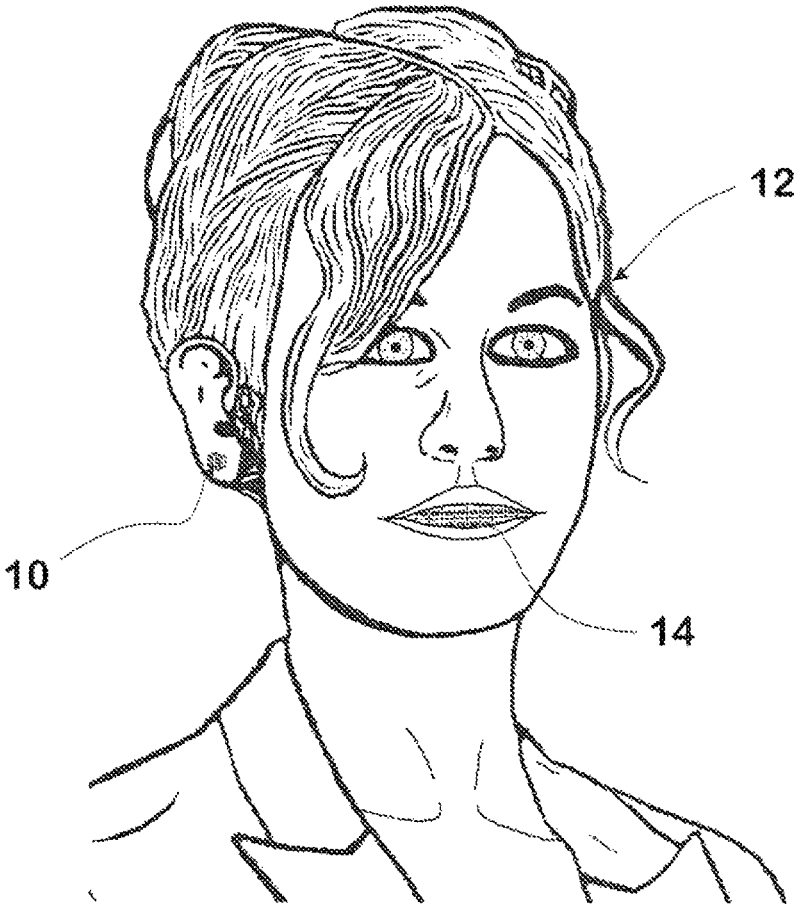
FIG. 1 is view of an earring according to one preferred embodiment of the present invention being worn by a wearer; The wearer can select the polymer band detachably secured to the earring to allow different color polymer bands to be located on the earring. The polymer band can be selected because the color complements the bracket bands incorporated into a wearer's braces or to complement hair, eye, skin, or clothing colors.

Certain terminology is used in the following description for convenience only and is not limiting. The words "right," "left," "top," and "bottom" designate directions in the drawings to which reference is made. The term "opposing surfaces" is defined as meaning generally opposed surfaces and does not require exact parallel orientation relative to each other. The words "inwardly" and "outwardly" refer to directions toward and away from, respectively, the geometric center of the earring and designated parts thereof. The language "at least one of 'A', 'B', and 'C'," (or "any one of 'A', 'B', and 'C',") as used in the claims and in corresponding portions of the specification, means "any group having at least one 'A'; or any group having at least one 'B'; or any group having at least one 'C';—and does not require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-11, wherein like numerals indicate like elements throughout, preferred embodiments of an earring according to the present invention are shown and generally designated as 10. Briefly speaking the earring 10 facilitates the customization of appearance by a wearer 12 and allows attractive coordination with braces 14, clothing, hair, etc., as shown in FIG. 1.

The earring 10 is preferably formed by a sturdy, non reactive, light weight material such as a metallic material or alloy, such as gold plated material. However, any suitable material can be used without departing from the scope of the present invention. For example, the earring can be formed of polyethylene terephthalate (PET), polyvinyl chloride (PVC), polyphthalate carbonate (PPC), metallic material, composite, or the like without departing from the scope of the present invention.

Figure 2:
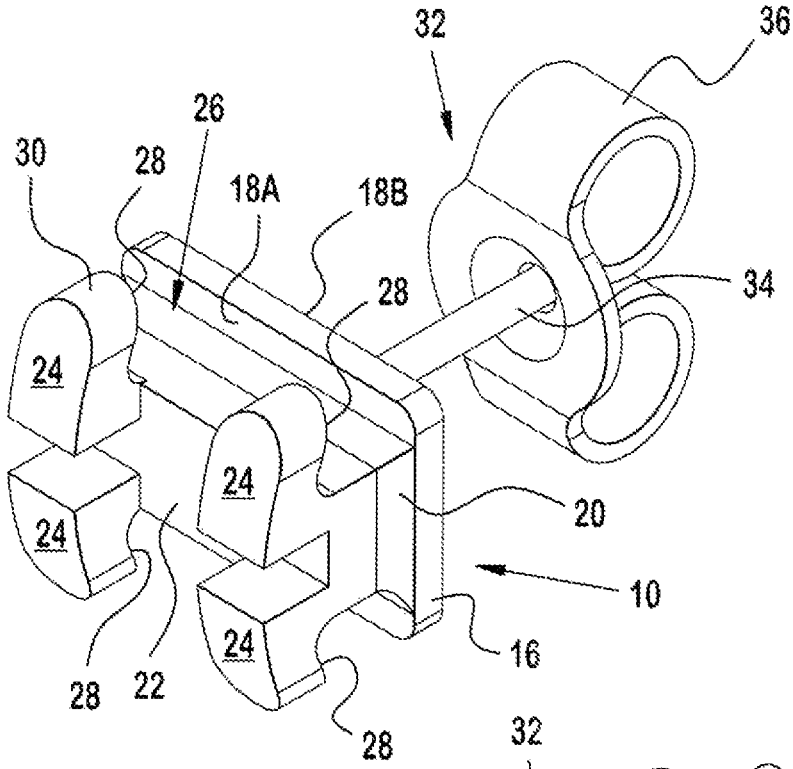
FIG. 2 is perspective view of one preferred embodiment of the earring of the present invention; The earring includes an earring body having first and second opposing surfaces; an earring attachment mechanism is located on second opposing surface; The attachment mechanism is preferably a post and earring backing, but could be a clip, magnet, adhesive, or any other suitable attachment mechanism without departing from the scope of the present invention; A plurality of posts are preferably attached to the first opposing surface via first and second spacers; One of ordinary skill in the art will appreciate from this disclosure that the posts can be directly positioned on the first opposing surface or integrated with the first and/or second spacers without departing from the scope of the present invention; There are preferably four posts that form catches configured to detachably engage a polymer band (shown in FIG. 3); it is preferred that the plurality of supports define a channel configured to receive the band therein, the channel having a base and an opening, the opening being more narrow than the base, as measured between a distal end of the support and the first opposing surface, to form a pinched section configured to assist in retaining the band in the channel.
Figure 3:
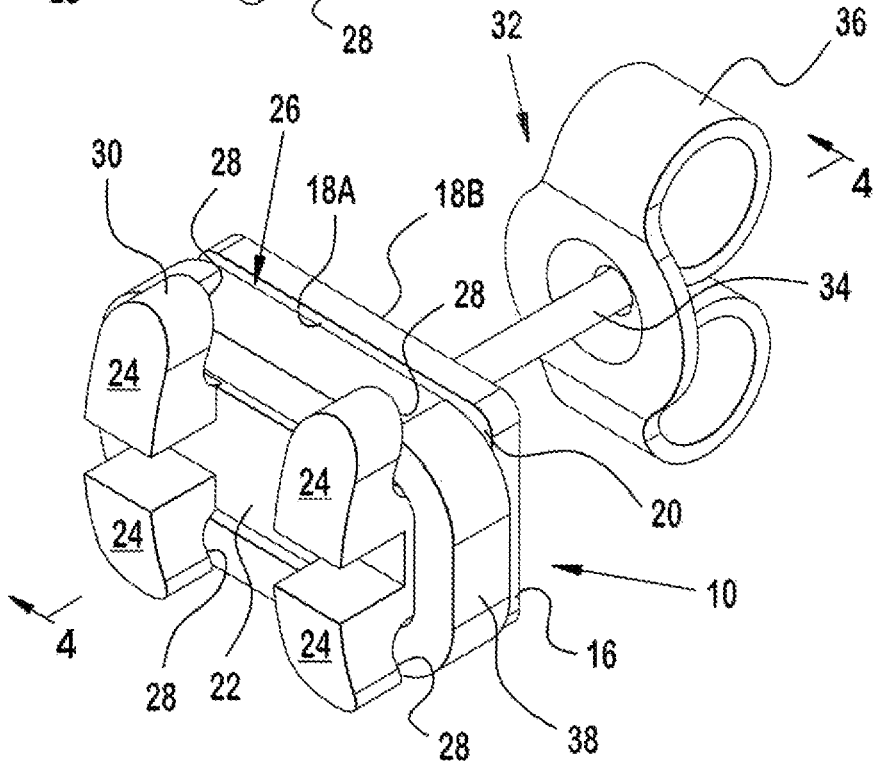
FIG. 3 is a second perspective view of the Earring of FIG. 2 illustrating a band detachably secured in the channel formed by the catches; The band can have the configuration shown or any other suitable configuration without departing from the scope of the present invention; It is preferred that the band is detachable, but it can be permanently affixed without departing from the scope of the present invention; While it is preferred that the band is formed by a polymer, those of ordinary skill in the art will appreciate from this disclosure that any suitable material can be used to form the band without departing from the scope of the present invention.
Figure 4:
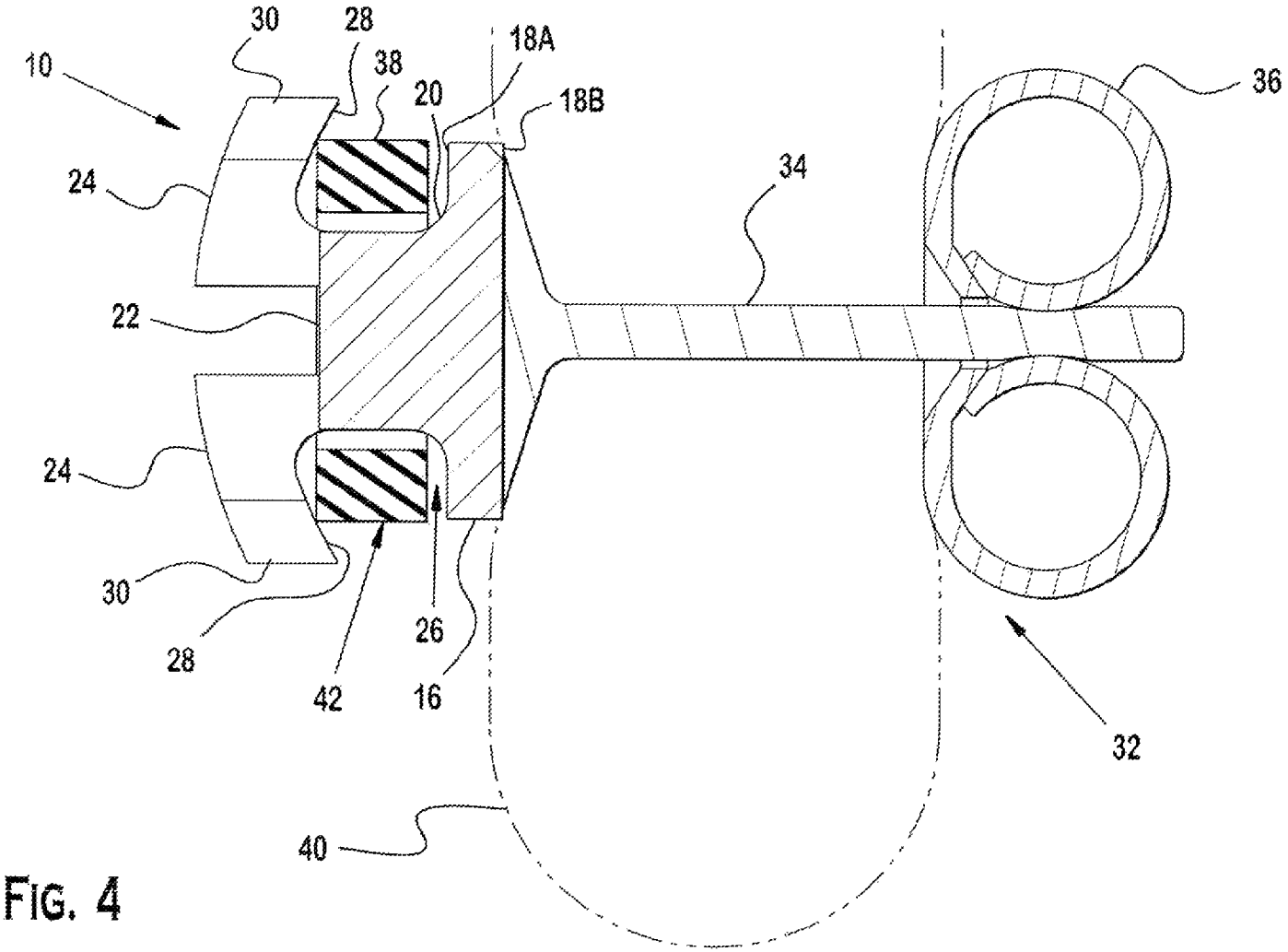
FIG. 4 is a cross sectional view of the earring of FIG. 3 as taken along the line 4-4 of FIG. 3; In this embodiment, the first and second spacers are actually part of the earring body so that the supports are still positioned on the first opposing surface thereof; The band is preferably, but not necessarily, formed of polymer and preferably has a generally rectilinear cross-section; However, the band can have any suitable cross section or shape without departing from the scope of the present invention; Similarly the supports can have any suitable shape, positioning on the earring body, and/or be of any number without departing from the scope of the present invention; The phantom lines denote an ear lobe through which the post is positioned such that the earring main body is on one side and the earring backing is on an opposite side of the ear; Those of ordinary skill in the art will appreciate from this disclosure that the post and/or earring backing can have any configuration without departing from the scope of the present invention; This Figure illustrates that the four supports are preferably, but not necessarily, configured to support the polymer band in a position such that the polymer band defines a plane that is generally parallel to the first opposing surface.

Referring to FIGS. 2-4, one embodiment of the earring 10 of the present invention includes an earring body 16 having first and second opposing surfaces 18A, 18B (these surfaces could also be referred to as first and second major surfaces 18A, 18B). The earring main body 16 preferably has a generally rectilinear shape with rounded corners. The earring main body 16 can have any other configuration without departing from the scope of the present invention. First and second spacers 20, 22 can be positioned on the earring main body 16 to form part thereof to effectively form part of the first opposing surface 18A.

As best shown in FIG. 3, a plurality of supports 24 may be positioned on the first opposing surface 18A each configured to provide a catch 28. Referring to FIG. 4, the plurality of supports preferably, but not necessarily, include four posts configured to support the band 38 in a position such that the band 38 defines a plane that is generally parallel to the first opposing surface 18A. The term generally parallel is defined as including any relative angle within ten degrees of parallel.

The band 38 is preferably, but not necessarily, detachably engaged with the plurality of supports. It is preferred that the plurality of supports 24 define a channel 28 configured to receive the band 38 therein. Referring to FIG. 2, the channel 28 may have a base and an opening with the opening being more narrow than the base, as measured between a distal end of the support and the first opposing surface, to form a pinched section configured to assist in retaining the band in the channel (as shown in FIG. 3). It is preferred that the band is formed of a polymer. However, those of ordinary skill in the art will appreciate from this disclosure that the bands may be formed of any suitable material without departing from the scope of the present invention. For example the band 38 may be formed by a spring, a colored spring, rope, twist tie, wire, snap fit material, hook and loop material, etc. without departing from the scope of the present invention. Still referring to FIG. 3, the bands 38 preferably have a generally rectilinear cross section 42. However, the cross section of the band 38, can be circular, triangular, irregular or the like without departing from the scope of the present invention.

In another embodiment of the present invention the earring can be used with a plurality of bands 38 configured to be interchangeable with the band 38 originally located on the plurality of supports 24. Referring to FIG. 2, the supports 24 form a channel 26 for receiving the band 38. The upper portion of the upper supports 24 and the lower portion of the lower supports preferably include a surface generally facing the first opposing surface 18A which is generally inwardly angled so that the opening of the channel is slightly more narrow than the base. This facilitates the retention of the band 38 by the posts which may form the supports 24.

Figure 8:
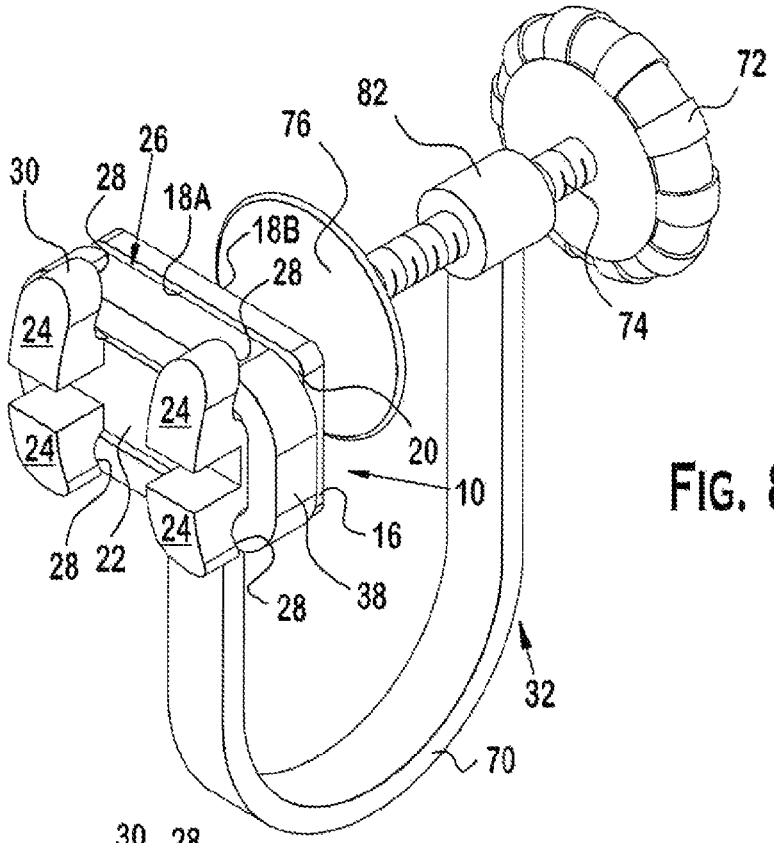
FIG. 8 is a perspective view of another embodiment of the earring of the present invention illustrating the ear attachment mechanism formed by a U-shaped member which connects the earring main body to a retainer; A threaded rod may be located through the retainer to allow a knob to move an earring backing to an appropriate position to secure a wearer's ear between the earring main body and the earring backing; The knob may be colored to match the polymer band.
Figure 10:
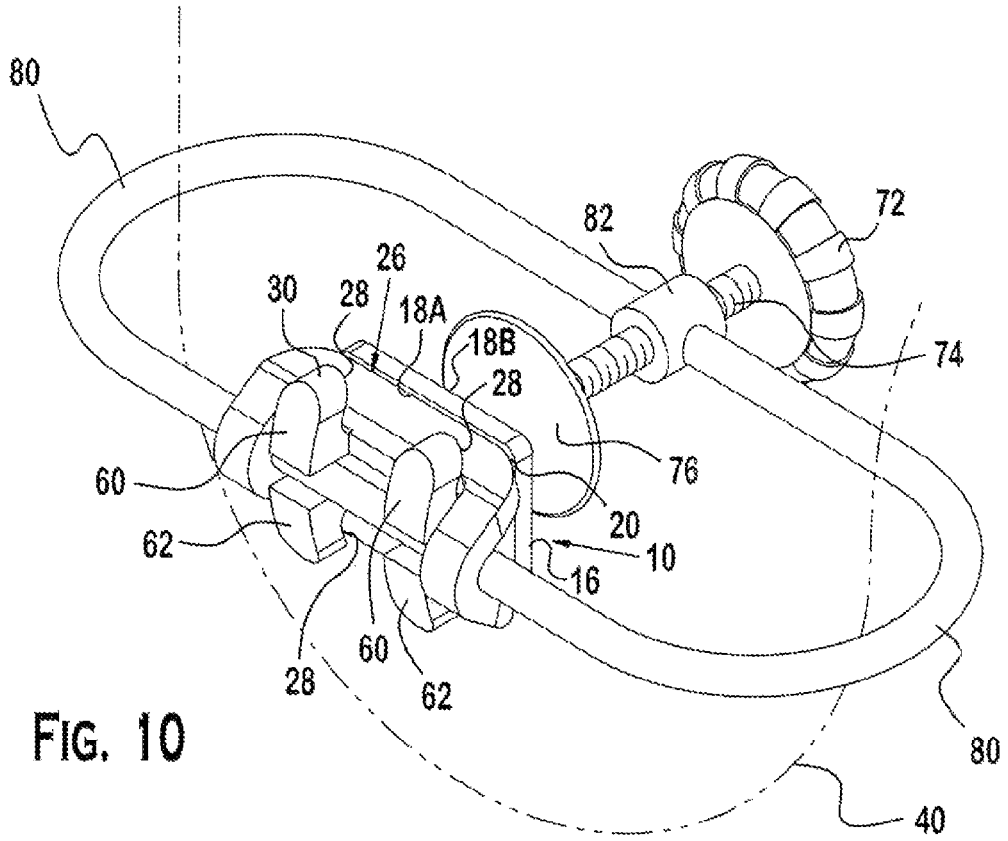
FIG. 10 is a perspective view of another embodiment of the earring of the present invention showing the ear attachment mechanism formed by a loop which extends from the abutment; The phantom lines show the outer surface of an ear; The loop may extend from the abutment or may be separate therefrom and instead connect to the earring main body without departing from the scope of the present invention.

Referring to FIGS. 3 and 4, an ear attachment mechanism 32 is preferably disposed on the second opposing surface 18B. Referring to FIGS. 2, 8, and 10, the ear attachment mechanism 32 can be any one of a post 34 configured for insertion through a pierced ear 40, a clip, a magnet, adhesive, a loop, or any other suitable securing device. Referring to FIG. 4, a post is preferably located on the second opposing surface 18B of the earring main body 16. The post preferably has a cylindrical shape. However, any post configuration can be used without departing from the scope of the present invention. An earring backing 36 is preferably engageable with the post 34 on an opposite side of the ear 40 from the earring main body 16 to secure the earring 10 in position.

Figure 7:
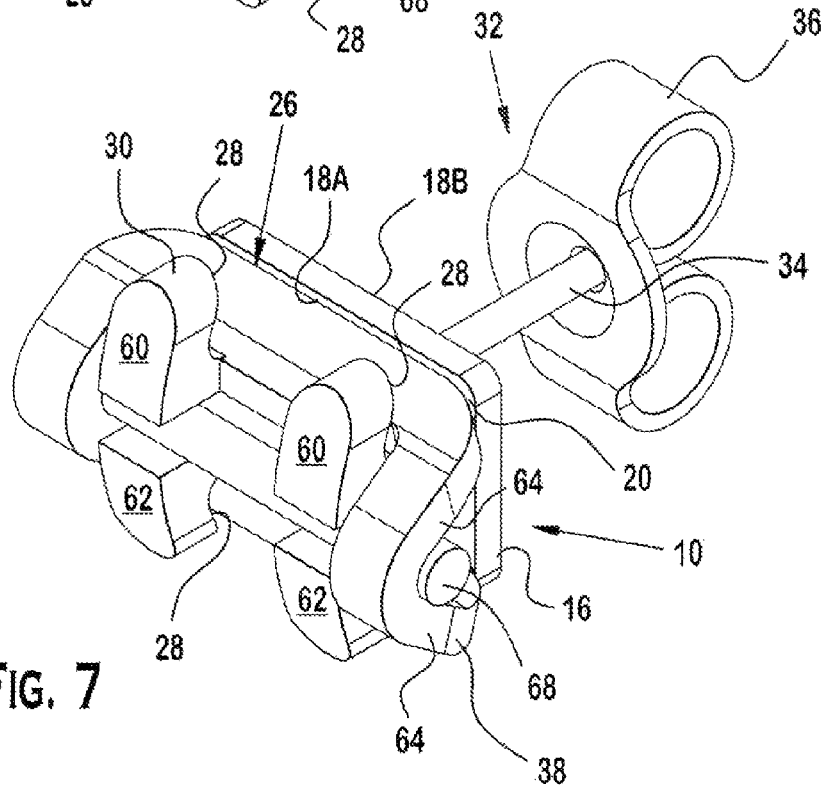
FIG. 7 is a second perspective view of earring of FIG. 6 illustrating a polymer band positioned through the catches formed by the posts and distended over the abutment to make the polymer band and any associated color more prominent; The abutment may cause the polymer band to project outwardly past the four posts, as measured perpendicular to the first opposing surface such that a portion of the polymer band generally forms a V-shaped configuration; While it is preferred that the band is formed by a polymer, the band can be formed by any suitable material(s) without departing from the scope of the present invention.

Referring to FIGS. 6, 7, 10, and 11, the earring 10 may include an abutment 58 separating the four posts 24 so that two posts 60 are above the abutment 58 and two posts 62 are below the abutment 58. The abutment 58 preferably causes the band 38 to project outwardly past the four posts 24, as measured perpendicular to the first opposing surface 18A such that a portion of the band 38 generally forms a V-shaped configuration 64. One preferred embodiment of the abutment 58 is a cylindrical member 58 with an outer surface 66 about which the band 38 can wrap around. Referring to FIG. 7, it is preferred that the ends 68 of the abutment 58 do not extend significantly past the outer end of the band 38. Although the abutment 58 is shown as a single cylindrical rod that abuts the band 38 on the left and right sides of the supports 24, those of ordinary skill in the art will appreciate from this disclosure that the abutment 58 can be two discreet structures that are positioned to abut the band 38 on the left and right sides of the supports 24 while not extending entirely across the first opposing surface of the earring 18A.

Figure 9:
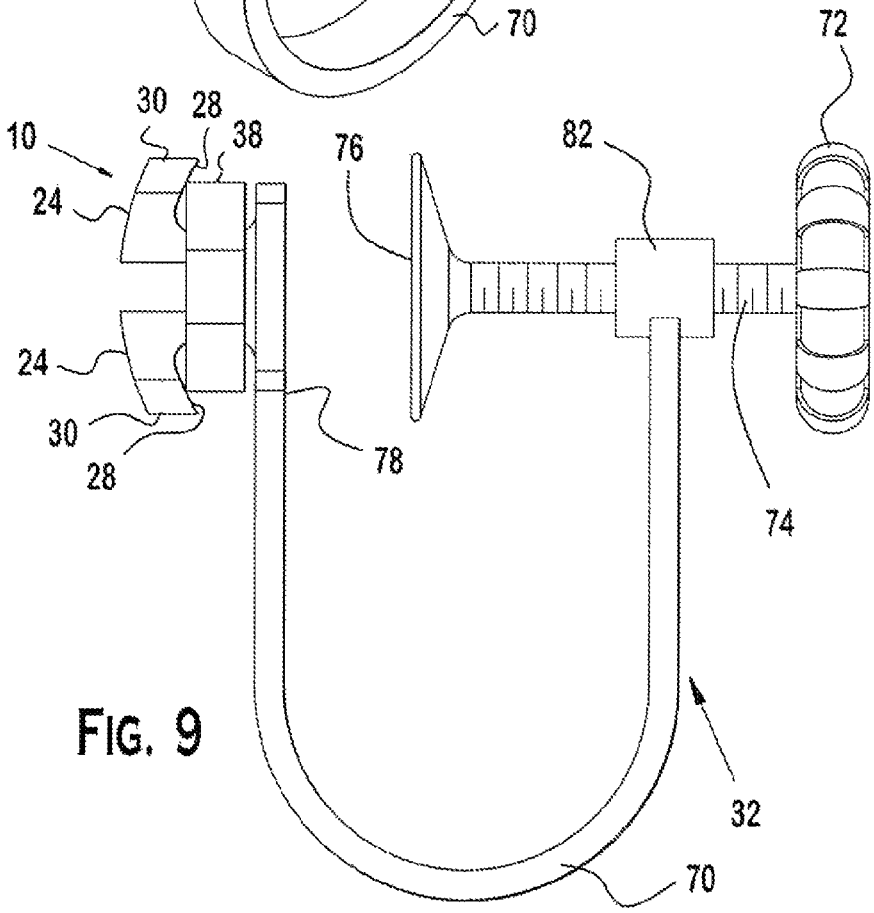
FIG. 9 is a side elevational view of the earring of FIG. 8.
Figure 11:
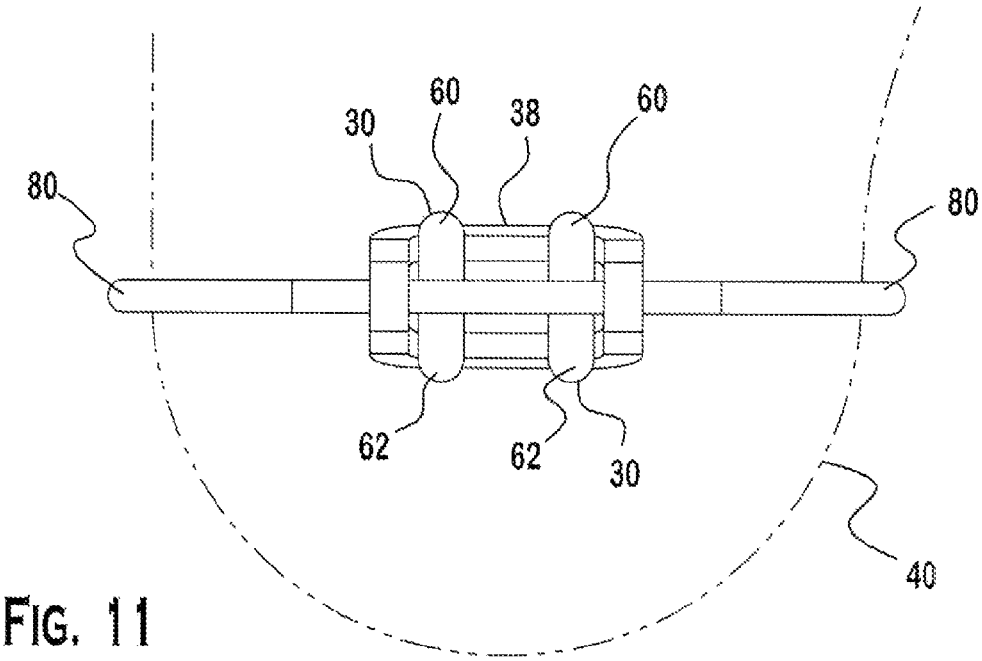
FIG. 11 is a side elevational view of the earring of FIG. 10.

Referring to FIGS. 10 and 11, the abutment may be integrated with a loop 80 that secures the earring 10 to an ear 40. In this case the loop 80 forms part of the ear attachment mechanism 32. The loop 80 preferably connects to a retainer 82 on an opposite side of the ear 40. A threaded rod 74 can extend through the retainer 82 and connects with the earring backing 76 on one side and with a knob 72 on the other side. Referring to FIGS. 8 and 9, the ear attachment mechanism 32 may also incorporate a U-shaped member 70 which can connect to the earring main body 16 at connection point 78. The U-shaped member 70 may connect to a retainer 82 and threaded rod 74 similar to that described in connection with the above loop 80.

In another embodiment of the present invention, the abutment 58 may be detachably engaged with the earring main body 16. For example, the abutment 58 may be magnetically attracted to the earring main body 16 due to placement of a magnet(s) in one or both of the components. Alternatively, the abutment 58 can connect to the earring main body via a tongue and groove connection. The actual connection between the abutment 58 and the earring main body 16 need only be sufficient enough to allow the band 38 to be wrapped around the abutment 58. Afterward, the abutment 58 can be held in place due to the frictional contact with the band 38.

Figure 5:
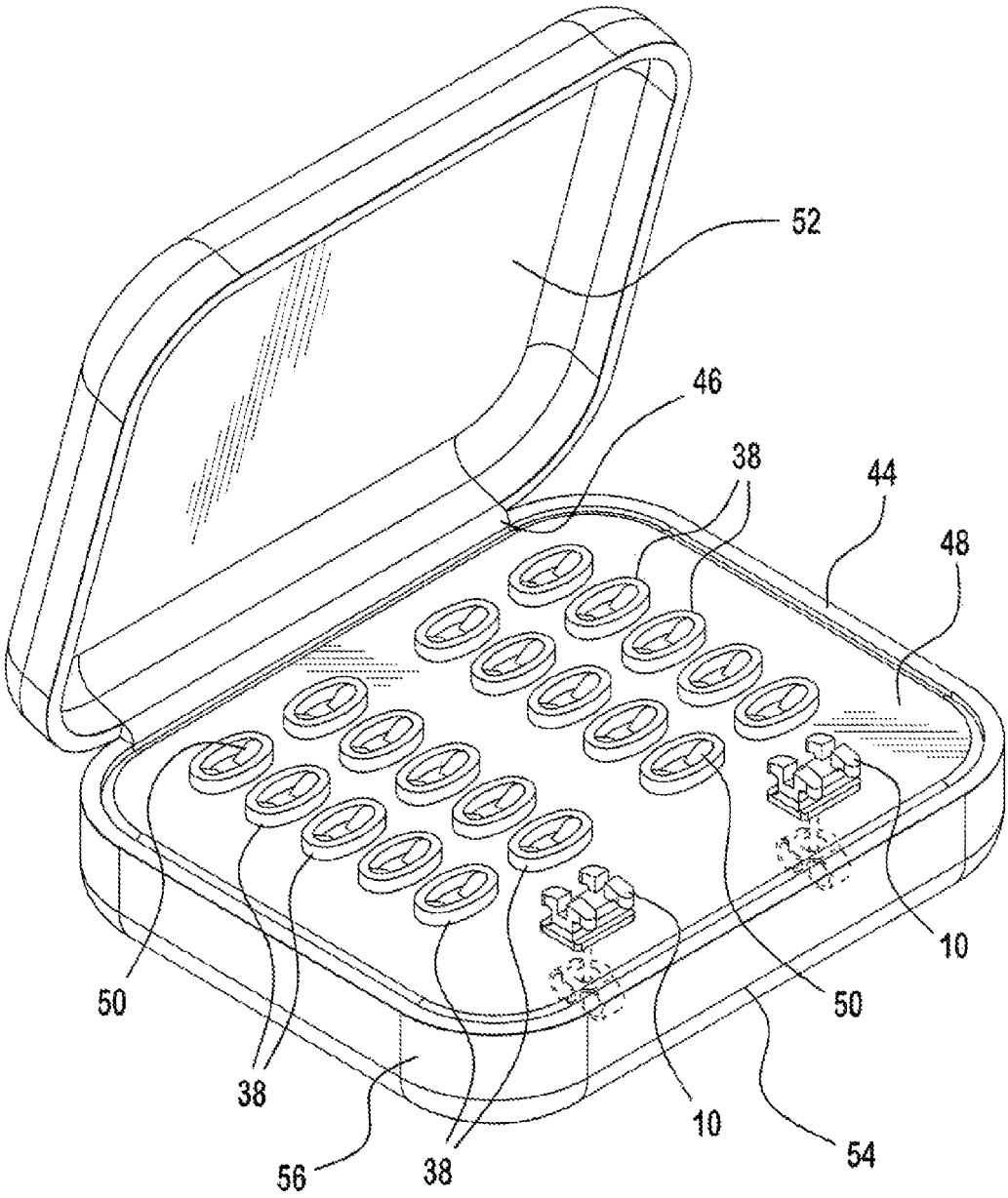
FIG. 5 is a perspective view of the earring of FIG. 2 and polymer bands packaged as a kit according to one embodiment of the present invention; The case may be hinged on one side via a plastic hinge that connects the lid to the base; It is preferred that a cutout is located in the base that allows the earring(s) to be secured therein; Band retainers may be positioned on or in the cutout to facilitate positioning bands prior to use; It is preferred, but not necessary, that the bands have different colors to allow customizing of the color of the earring based on the desire of the wearer; Although the kit is shown as including two earrings and twenty polymer bands, those of ordinary skill in the art will appreciate from this disclosure that any number of bands or earrings can be included in the kit without departing from the scope of the present invention.
Figure 6:
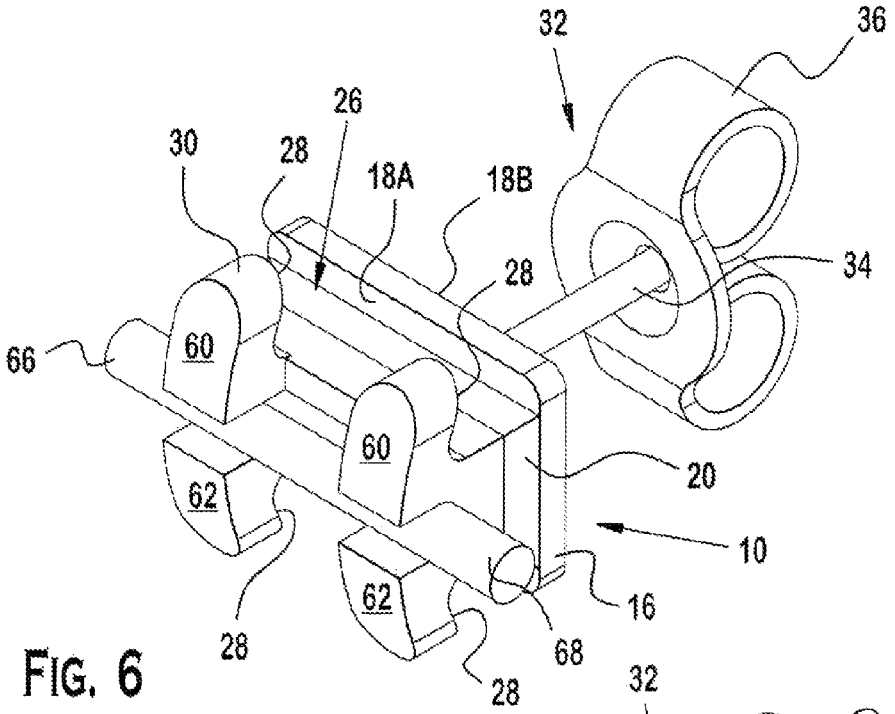
FIG. 6 is a is a perspective view of another embodiment of the earring according to the present invention; An abutment is positioned between and separating the four posts so that two posts are above the abutment and two posts are below the abutment; Although the abutment is shown as a single cylindrical rod that abuts the band on the left and right sides of the supports, those of ordinary skill in the art will appreciate from this disclosure that the abutment can be two discreet structures that are positioned to abut the band on the left and right sides of the supports while not extending entirely across the first opposing surface of the earring; Furthermore, the abutment may be detachable from the earring to allow for its optional use; For example the abutment can be magnetically secured to the earring body to hold the components in position until the band is secured thereover to hold both components together; Any other suitable fastening method can also be used without departing from the scope of the present invention; Although the abutment is shown as having a generally cylindrical shape, those of ordinary skill in the art will appreciate from this disclosure that the abutment(s) can have any configuration without departing from the scope of the present invention.

Referring to FIG. 5, one embodiment of the present invention is directed to a kit which includes at least one earring 10 and one or more bands 38. The kit may come in a case 44 having a base 54 and a lid 52 connected by a plastic hinge 46. It is preferred, but not necessary, that the kit includes the case 44 with a cutout 48 therein for securing the earrings 10 and bands 38. The bands 38 may be secured to the cutout 48 via band retainers 50. The circumferential edges 56 of the case 44 are preferably curved.

A preferred embodiment of using an earring according to the present invention is described below. Those of ordinary skill in the art will appreciate from this disclosure that generally similar steps and generally similar structural components of the earring 10 described above may: generally have similar structure, generally include similar alternate constructions, and generally operate in a similar manner as that described above, unless stated otherwise. The steps of the method of the present invention can be performed in any order, interchanged with other steps, or omitted, without departing from the scope of the present invention.

One preferred method of using earrings to accessorize a wearer's appearance may include the step of providing an earring 10. The earring may include an earring body 16 having first and second opposing surfaces 18A, 18B. A plurality of supports 24 may be positioned on the first opposing surface 18A each configured to provide a catch. An ear attachment mechanism 32 can be disposed on the second opposing surface 18B.

Alternatively, the band 38 can be directly attached to the earring body without the use of supports 24. For example, the band 38 may include a metallic element and the earring body 16 a magnet to allow the band 38 to be positioned thereon and held in place. Examples of a band with a metallic element would be a small metallic plate with a band adhesively attached on one side, a braided rope around a metallic wire, or a fiber core with a metallic covering (such as cotton plated with colored alloy), or the like.

The step of providing the earring 10 may include the plurality of supports 24 having four posts configured to support the possibly polymer band 38 in a position such that the polymer band defines a plane that is generally parallel to the first opposing surface 18A. The method may include providing an abutment 58 separating the four posts 24 so that two posts are above the abutment 58 and two posts are below the abutment 58. The abutment 58 may cause the polymer band 38 to project outwardly past the four posts, as measured perpendicular to the first opposing surface 18A, such that a portion of the polymer band 38 generally forms a V-shaped configuration 64.

The method may also include the step of providing a band 38 that is detachably engaged with the plurality of supports 24. The band 38 may have a color which accessorizes the wearer's 12 appearance. The method may also include providing a plurality of polymer bands 38 each having a different color so that the wearer can select the proper color band 38 to secure to the earring 10 to accessorize the wearer's appearance. The plurality of bands 38 and the earring 10 may also be part of a kit that may include two of the earrings 10 and the plurality of bands 38.

The method of the present invention may include coordinating the color of the band 38 on the earring 10 with braces 14 worn by the wearer 12 of the earring 10. The method may also include the of coordinating the color of the band 38 on the earring 10 with braces 14 worn by the wearer 12 of the earring 10.

A second preferred embodiment of a method of using earrings 10 to accessorize a wearer's 12 appearance may include providing an earring 10. The earring body 16 has first and second opposing surfaces 18A, 18B. A plurality of supports 24 may be positioned on the first opposing surface 18A and each configured to provide a catch. The plurality of supports 24 can have four posts configured to support the band 38 in a position such that the band 38 defines a plane that is generally parallel to the first opposing surface 18A. The earring 10 preferably includes an abutment 58 separating the four posts so that two posts 60 are above the abutment 58 and two posts 62 are below the abutment 58. The abutment 589 may cause the band 38 to project outwardly past the four posts 60, 62, as measured perpendicular to the first opposing surface 18A such that a portion of the band 38 generally forms a V-shaped configuration 64.

An ear attachment mechanism 32 can be disposed on the second opposing surface 18B. The method preferably includes positioning a band 38 so as to detachably engage the plurality of supports 24 of the earring 10. The polymer band may have a color which coordinates with dental braces bands positioned on braces 14 worn by the wearer 12 of the earring 10.

The method may include providing a plurality of bands 38 each having a different color so that the wearer 12 can select the proper color band to secure to the earring 10 to accessorize the wearer's 12 appearance.

While various shapes, configurations, and features have been described above and shown in the drawings for the various embodiments of the present invention, those of ordinary skill in the art will appreciate from this disclosure that any combination of the above features can be used without departing from the scope of the present invention. For example, the earring can have any configuration, any number of supports thereon, and/or have combination of different types of colored components without departing from the scope of the present invention. It is understood, therefore, that this invention is not limited to the particular embodiments disclosed, but is intended to cover all modifications which are within the spirit and scope of the invention as defined by the appended claims and/or shown in the attached drawings.

What is claimed is:

1. An earring, comprising:

an earring body having first and second opposing surfaces;

a plurality of supports positioned on the first surface each configured to provide a catch;

a band detachably engaged with the plurality of supports; and an ear attachment mechanism disposed on the second opposing surface.

2. The earring of claim 1, wherein the ear attachment mechanism is any one of a post configured for insertion through a pierced ear, a clip, and a magnet.

3. The earring of claim 2, wherein the plurality of supports comprise four posts configured to support the band in a position such that the band defines a plane that is generally parallel to the first opposing surface.

4. The earring of claim 3, further comprising an abutment separating the four posts so that two posts are above the abutment and two posts are below the abutment, the abutment causing the band to project outwardly past the four posts, as measured perpendicular to the first opposing surface such that a portion of the band generally forms a V-shaped configuration.

5. The earring of claim 4, further comprising a plurality of polymer configured to be interchangeable with the band on the plurality of supports.

6. The earring of claim 4, wherein the abutment is detachably engaged with the earring main body.

7. The earring of claim 6, wherein the abutment is magnetically attracted to the earring main body.

8. The earring of claim 1, wherein the plurality of supports define a channel configured to receive the band therein, the channel having a base and an opening, the opening being more narrow than the base, as measured between a distal end of the support and the first opposing surface, to form a pinch section configured to assist in retaining the band in the channel.

9. A method of using earrings to accessorize a wearer's appearance, comprising:

providing an earring, comprising:

an earring body having first and second opposing surfaces;

a plurality of supports positioned on the first opposing surface each configured to provide a catch; and an ear attachment mechanism disposed on the second opposing surface; and providing a band detachably engaged with the plurality of supports, the band having a color which accessorizes the wearer's appearance;

providing a plurality of polymer bands each having a different color so that the wearer can select the proper color band to secure to the earring to accessorize the wearer's appearance;

comprising the steps of coordinating the color of the polymer band on the earring with braces worn by the wearer of the earring.

10. The method of claim 9, wherein the plurality of bands and the earring are part of a kit.

11. The method of claim 10, wherein the kit comprises two of the earrings and the plurality of bands.

12. The method of claim 9, wherein the step of providing the earring comprises the plurality of supports having four posts configured to support the band in a position such that the band defines a plane that is generally parallel to the first surface.

13. The method of claim 12, where the step of providing the earring further comprises an abutment separating the four posts so that two posts are above the abutment and two posts are below the abutment, the abutment causing the band to project outwardly past the four posts, as measured perpendicular to the first opposing surface such that a portion of the band generally forms a V-shaped configuration.

14. The method of claim 13, further comprising the steps of coordinating the color of the band on the earring with braces worn by the wearer of the earring.

15. The method of claim 9, further comprising the steps of coordinating the color of the band on the earring with braces worn by the wearer of the earring.

16. A method of using earrings to accessorize a wearer's appearance, comprising:

providing an earring, comprising:

an earring body having first and second opposing surfaces;

a plurality of supports positioned on the first opposing surface each configured to provide a catch; and an ear attachment mechanism disposed on the second opposing surface; and positioning a band so as to detachably engage the plurality of supports of the earring, the band having a color which coordinates with dental braces bands positioned on braces worn by the wearer of the earring;

providing a plurality of polymer bands each having a different color so that the wearer can select the proper color band to secure to the earring to accessorize the wearer's appearance;

providing a kit comprised of the plurality of bands and two of the earrings.

17. The method of claim 16, wherein the step of providing the earring comprises the plurality of supports having four posts configured to support the band in a position such that the band defines a plane that is generally parallel to the first opposing surface.

18. The method of claim 17, where the step of providing the earring further comprises an abutment separating the four posts so that two posts are above the abutment and two posts are below the abutment, the abutment causing the band to project outwardly past the four posts, as measured perpendicular to the first opposing surface such that a portion of the band generally forms a V-shaped configuration.

* * * * *